US006305467B1

(12) United States Patent
Connell et al.

(10) Patent No.: US 6,305,467 B1
(45) **Date of Patent: *Oct. 23, 2001**

(54) WIRELESS COILED TUBING JOINT LOCATOR

(75) Inventors: Michael L. Connell, Duncan; James C. Tucker, Springer; Robert G. Howard, Duncan, all of OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/492,002

(22) Filed: Jan. 26, 2000

Related U.S. Application Data

(63) Continuation-in-part of application No. 09/144,751, filed on Sep. 1, 1998, now Pat. No. 6,253,842.

(51) Int. Cl.[7] ..... E21B 29/02

(52) U.S. Cl. ..... 166/66; 166/64; 166/66.5; 73/152.01; 73/152.57

(58) Field of Search ..... 166/255.1, 64, 166/66, 66.5, 66.7, 67; 73/152.01, 152.57, 152.02, 152.37

(56) References Cited

U.S. PATENT DOCUMENTS

| | | | |
|---|---|---|---|
| 5,234,053 | 8/1993 | Connell | 166/250 |
| 5,429,190 | 7/1995 | Kilgore et al. | 166/255 |
| 5,626,192 | 5/1997 | Connell et al. | 166/255.1 |
| 5,873,414 * | 2/1999 | Von Gynz-Rekowski | 166/319 |

FOREIGN PATENT DOCUMENTS

| | | |
|---|---|---|
| 2310444 | 8/1997 | (GB) . |
| 2341197 | 3/2000 | (GB) . |

OTHER PUBLICATIONS

Nonvolatile Electronics, Inc. Catalog (Undated but admitted to be prior art).

* cited by examiner

*Primary Examiner*—Hoang Dang
(74) *Attorney, Agent, or Firm*—Robert A. Kent; Neal R. Kennedy

(57) ABSTRACT

A wireless coiled tubing joint locator for locating joints or collars in a production tubing string. An electromagnetic coil assembly or giant magnetoresistive digital field sensor senses the increased mass of a pipe joint, and provides a signal to an electric circuit which generates a signal received by a pilot solenoid valve. The solenoid valve momentarily opens a pilot passageway which activates a piston to close a circulation port in the joint locator, resulting in an increase in a surface pressure reading observable by the operator. In one embodiment, a rupture disk is provided so that pressure cannot be applied to any downhole tool below the joint locator prematurely. A seat sleeve prevents premature communication of fluid to the rupture disk but can be opened by dropping a ball into the joint locator. A second embodiment may be used for either logging or washing operations or both. The electronic circuit can provide a selected one of a plurality of time delays. A fixed test period in the circuit delays activation of the time delay so that the joint locator may be tested before it is run into the well. The electric circuit and power supply are provided in a removable case.

81 Claims, 7 Drawing Sheets

WIRELESS COILED TUBING JOINT LOCATOR

This is a continuation in part of application Ser. No. 09/144,751, filed Sep. 1, 1998, now U.S. Pat. No. 6,253,842.

BACKGROUND OF THE INVENTION

1. Field of the Invention

The present invention relates generally to subterranean pipe string joint locators, and more particularly, to a joint locator for positioning on a well tool connected to coiled tubing in a well and which has a pressure differential actuated piston controlled by a pilot solenoid valve.

2. Description of the Prior Art

In the drilling and completion of oil and gas wells, a wellbore is drilled into the subterranean producing formation or zone of interest. A string of pipe, e.g., casing, is typically then cemented in the wellbore, and a string of additional pipe, known as production tubing, for conducting produced fluids out of the wellbore is disposed within the cemented string of pipe. The subterranean strings of pipe are each comprised of a plurality of pipe sections which are threadedly joined together. The pipe joints, also often referred to as collars, are of an increased mass as compared to other portions of the pipe sections.

It is often necessary to precisely locate one or more of the pipe joints of the casing, a liner or the production tubing in the well. This need arises, for example, when it is necessary to precisely locate a well tool, such as a packer, within one of the pipe strings in the wellbore. The well tool is typically lowered into the pipe string on a length of coiled tubing, and the depth of a particular pipe joint adjacent to or near the location to which the tool is positioned can be readily found on a previously recorded casing joint or collar log for the well. That is, after open hole logs have been run in a drilled wellbore and one or more pipe strings have been cemented therein, an additional log is typically run within the pipe strings. The logging tools used include a pipe joint locator whereby the depths of each of the pipe joints through which the logging tools are passed is recorded. The logging tools generally also include a gamma ray logging device which records the depths and the levels of naturally occurring gamma rays that are emitted from various well formations. The additional log is correlated with the previous open hole logs which result in a very accurate record of the depths of the pipe joints across the subterranean zones of interest referred to as the casing joint or collar log.

Given this readily available pipe joint depth information, it would seem to be a straightforward task to simply lower the well tool connected to a length of coiled tubing into the pipe string while measuring the length of coiled tubing in the pipe string by means of a conventional surface coiled tubing measuring device until the measuring device reading equals the depth of the desired well tool location as indicated on the joint and tally log. However, no matter how accurate the coiled tubing surface measuring device is, true depth measurement is flawed due to effects such as coiled tubing stretch, elongation from thermal effects, sinusoidal and helical buckling, and a variety of often unpredictable deformations in the length of coiled tubing suspended in the wellbore.

Attempts have been made to more accurately control the depth of well tools connected to coiled tubing. For example, a production tubing end locator has been utilized attached at the end of the coiled tubing. The production tubing end locator tool usually consists of collets or heavy bow strings that spring outwardly when the tool is lowered beyond the end of the production tubing string. When the coiled tubing is raised and the tool is pulled back into the production tubing string, a drag force is generated by the collets or bow springs that is registered by a weight indicator at the surface.

The use of such production tubing string end locator tools involve a number of problems. The most common problem is that not all wells include production tubing strings and only have casing or are produced open hole. Thus, in those wells there is not production tubing string on which the tool can catch while moving upwardly. Another problem associated with the lower end of the production tubing string as a locator point is that the tubing end may not be accurately located with respect to the producing zone. Tubing section lengths are tallied as they are run in the well and mathematical or length measurement errors are common. Even when the tubing sections are measured and tallied accurately, the joint and tally log can be inaccurate with respect to where the end of the tubing string is relative to the zone of interest. Yet another problem in the use of production tubing in locator tools is that a different sized tool must be used for different sizes of tubing. Further, in deviated or deep wells, the small weight increase as a result of the drag produced by the end locator tool is not enough to be noticeable at the surface.

While a variety of other types of pipe string joint indicators have been developed including sick line indicators that produce a drag inside the tubing string, wireline indicators that send an electronic signal to the surface by way of electric cable and others, they either cannot be utilized as a component in a coiled tubing well tool system or have disadvantages when so used. One improved coiled tubing joint locator tool and methods of using the tool are disclosed in U.S. Pat. No. 5,626,192, assigned to the assignee of the present invention. This tubing joint locator does not require the use of electric cable and overcomes other shortcomings of earlier prior art. This joint locator has a longitudinal fluid flow passageway therethrough so that fluid can be flowed through the coiled tubing and the joint indicator and has at least one lateral port extending through a side thereof which provides communication between the fluid flow passageway and the well annulus outside the tool. An electronic means detects the increased mass of a pipe joint as the locator is moved through the pipe joint and generates a momentary electric output signal in response thereto. A valve means is actuated in response to the electric output signal to momentarily open or close the lateral port which creates a surface detectable pressure drop or rise in the fluid flowing through the coiled tubing and the joint locator indicative of the location of the pipe joint. The valve is connected to the solenoid and is mechanically directly opened or closed thereby.

In some cases, the output of the solenoid may be insufficient to overcome the friction of the sleeve particularly with smaller tools with size restrictions. The present invention solves this problem by using a pilot operated solenoid valve which communicates fluid pressure to a piston such that the pressure differential inside the tool and outside the tool moves the piston to close a normally open circulating port. The pilot operated solenoid valve decreases the stroke necessary for the solenoid valve and further reduces the power requirements proportionally.

Another potential problem with the apparatus shown in U.S. Pat. No. 5,626,192 is the pressure spike caused by closing the circulating port might interfere with or cause premature operation of pressure sensitive tools which are located in the tubing string below the coiled tubing joint locator. One embodiment of the present invention solves this problem by providing a rupture disk which opens only at a predetermined pressure, and pressure can only be communicated to the rupture disk after circulating a ball through the tubing string and applying sufficient pressure to actuate a sliding sleeve.

In applications where such a pressure spike is not a problem, an alternate embodiment of the invention does not include the rupture disk but allows fluid to flow axially through the joint locator when the pilot operator solenoid valve is open. This allows the joint locator to be used for washing or circulating fluids at the same time logging operations are being performed rather than only allowing washing operations after all logging passes are complete as in the first embodiment.

The present invention also includes the improvement to the apparatus shown in U.S. Pat. No. 5,626,192 of incorporating a selection of time delays in the electric means which prevents the solenoid valve from being actuated before it is desired. This reduces the power drain on the batteries as the tool is run into the well until the desired depth of the tool has been reached. The circuitry provides a fixed test period prior to activation of the time delay which allows the tool to be functionally checked before it is run into the well.

SUMMARY OF THE INVENTION

The present invention is an improved coiled tubing joint locator which allows fluid flow therethrough and does not require an electrical connection with the surface. It has a modular configuration which allows easy replacement and rearrangement of the major components.

The joint locator comprises a housing having an upper end adapted for connection to a length of coiled tubing whereby the locator may be moved within the pipe string in response to movement of the coiled tubing, the housing defining a central opening therethrough and a normally open circulation port in communication with the central opening. The joint locator further comprises a valve disposed in the housing for momentarily closing the circulation port in response to a pressure differential between the coiled tubing and a well annulus outside the housing, and an electronic means disposed in the housing for detecting an increased mass of a pipe joint and generating a momentary electric output signal in response thereto, thereby placing the valve in communication with the pressure in the coiled tubing in response to the signal. The valve is preferably a solenoid valve, and the electronic means preferably comprises a pilot solenoid in the valve which opens in response to the signal and places the valve in communication with the pressure in the coiled tubing. The housing defines a pilot passageway therein a communication with an upper portion of the valve and an annulus or vent port in communication with a lower portion of the valve. The solenoid is adapted to open the pilot passageway in response to the signal.

In one embodiment, the electronic means also comprises an electromagnetic coil assembly, including a coil and magnet, for electromagnetically sensing the increased mass of the pipe joint. Alternatively, the electronic means may comprise a giant magnetoresistive digital field sensor for electromagnetically sensing the increased mass of the pipe joint. The electronic means further comprises an electric power source and electric circuit means for generating a signal when the coil or sensor electromagnetically senses the increased mass. The electronic circuit means has a time delay circuit with a preselectable time delay therein which prevents premature draining of the electric power source. The time delay circuit includes a test time period which allows testing of the joint locator at the surface prior to initiation of the time delay. The power source and electric circuit means are preferably disposed in an electric case which is removable from the housing. This case is preferably threadingly connected to an upper end of the housing.

In a first embodiment, the joint locator also comprises pressure isolation means for preventing premature communication between the pressure in the coiled tubing and a bottom portion of the housing below the communication port which is transversely disposed. This pressure isolation means may comprise a rupture disk. The pressure isolation means preferably also comprises a valve having a seat thereon and a flow passageway therethrough and a ball engageable with the seat after the ball is circulated down through the coiled tubing string into the joint locator. The valve has a closed position wherein flow through the passageway is prevented and an open position wherein flow through the passageway is allowed. When the ball is engaged with the seat, fluid communication through the circulation port is prevented, and when a predetermined pressure is applied to the valve and ball, the valve is moved from the closed position to the open position thereof. The valve comprises a seat body fixedly disposed in the housing and forming a lower portion of the flow passageway, and a seat sleeve slidably disposed in the seat body and forming an upper portion of the flow passageway. The upper portion of the passageway is in communication with the lower portion of the passageway when the valve is in the open position thereof. The valve further comprises shear means for initially shearably holding the seat sleeve in the closed position thereof.

In a second embodiment, an insert is disposed in the housing. The insert defines a flow conduit therein providing communication between the central opening in the housing and a longitudinally disposed circulation port adjacent to the bottom of the housing.

Stated another way, the joint locator is an apparatus for locating joints in a well pipe string comprising a housing having an upper end connectable to a length of coil tubing and defining a central opening therethrough and a transfer circulation port in communication with the central housing, and an electronic assembly disposed in the housing. The electronic assembly comprises a sensing means for detecting an increased mass of a pipe joint, and an electric module comprising a power source and an electric circuit connected thereto and to the sensing means. The electronic circuit generates a momentary electric output signal in response to the detection of the increased mass by the sensing means, and the electric module is removable as an integral unit from the housing. The apparatus further comprises valve means disposed in the housing for momentarily closing the circulating port in response to the electric output signal.

Numerous objects and advantages of the invention will become apparent to those skilled in the art when the following detailed description of the preferred embodiment is read in conjunction with the drawings which illustrate such embodiment.

BRIEF DESCRIPTION OF THE DRAWINGS

FIG. 6 shows a flow chart of the control circuitry used in an alternate embodiment.

DESCRIPTION OF THE PREFERRED EMBODIMENTS

After a well has been drilled, completed and placed in production, it is often necessary to service the well whereby procedures are performed therein such as perforating, setting plugs, setting cement retainers, spotting permanent packers and the like. Such procedures are often carried out by utilizing coiled tubing. Coiled tubing is a relatively small flexible tubing, usually one to two inches in diameter, which can be stored on a reel when not being used. When used for performing will procedures, the tubing is passed through an injector mechanism, and a well tool is connected to the end thereof. The injector mechanism pulls the tubing from the reel, straightens the tubing and injects it through a seal assembly at the wellhead, often referred to as a stuffing box. Typically, the injector mechanism injects thousands of feet of the coiled tubing with the well tool connected at the bottom end thereof into the casing string or the production tubing string of the well. A fluid, most often a liquid such as salt water, brine or a hydrocarbon liquid, is circulated through the coiled tubing for operating the well tool or other purpose. The coiled tubing injector at the surface is used to raise and lower the coiled tubing and the well tool during the service procedure and to remove the coiled tubing and well tool as the tubing is rewound on the reel at the end of the procedure.

Figures 1, 3:
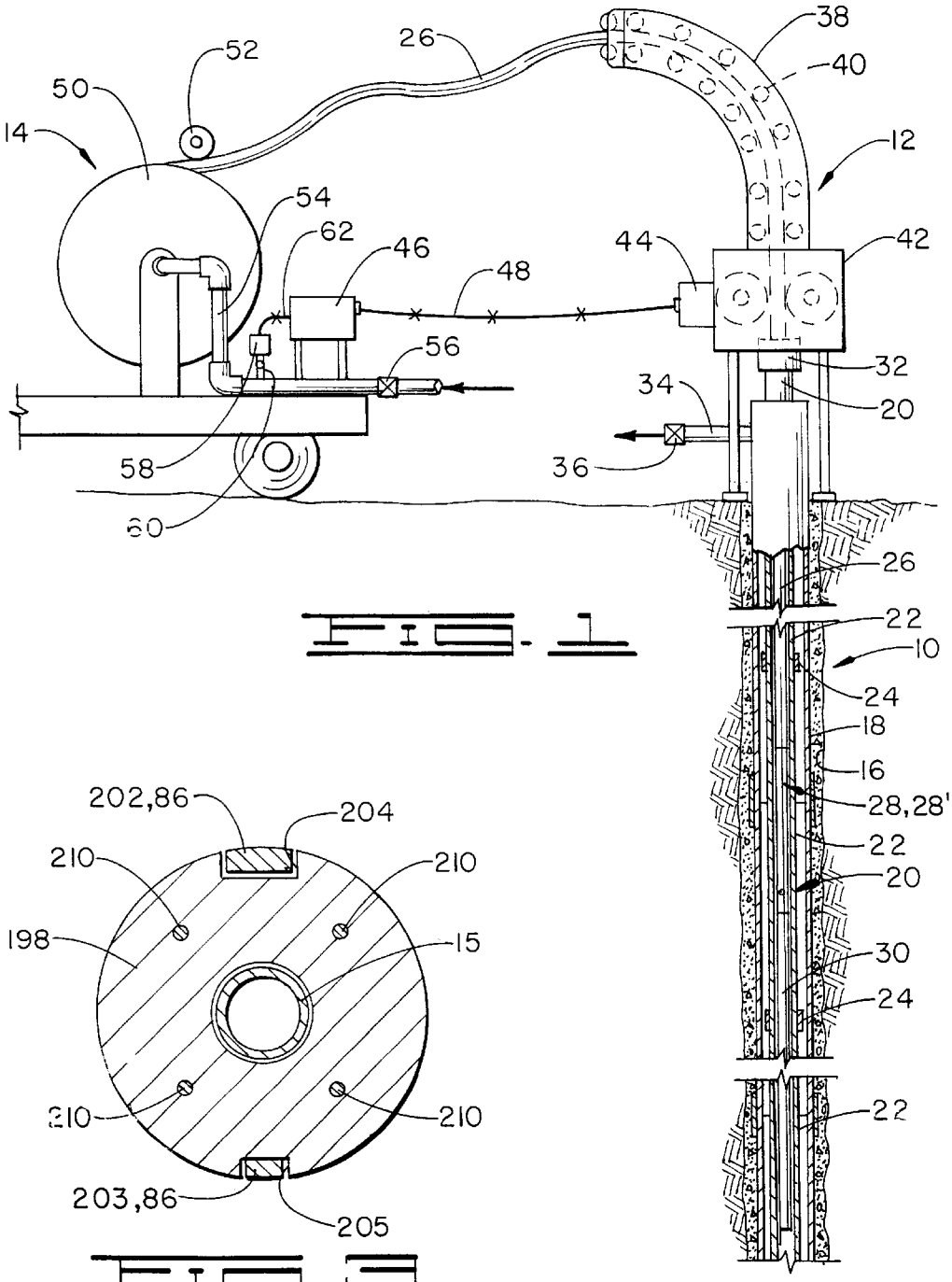
FIG. 1 is a schematic illustration of a cased well having a string of production tubing disposed therein and having a length of coiled tubing with a first embodiment of the wireless coiled tubing collar or joint locator of the present invention connected thereto and inserted into the well by a coiled tubing injector and truck mounted reel.
FIG. 3 is a cross section taken along lines 3—3 in FIG. 2C.

Referring now to FIG. 1, a well 10 is schematically illustrated along with a coiled tubing injector 12 and a truck mounted coiled tubing reel assembly 14. Well 10 includes a wellbore 16 having a string of casing 18 cemented therein in the usual manner. A string of production tubing 20 is also shown installed in well 10 within casing string 18. Production string 20 is made up of a plurality of tubing sections 22 connected by a plurality of joints or collars 24 in a manner known in the art.

A length of coiled tubing 26 is shown positioned in production tubing string 20. First and second embodiments of the wireless coiled tubing collar or joint locator of the present invention is generally designated in FIG. 1 by the numerals 28 and 28', respectively. Either is attached to the lower end of coiled tubing 26. One or more well tools 30 may be attached below joint locator 28 or 28'.

FIRST EMBODIMENT

Coiled tubing 26 is inserted into well 10 by injector 12 through a stuffing box 32 attached to the upper end of tubing string 20. Stuffing box 32 functions to provide a seal between coiled tubing 26 and production tubing string 20 whereby pressurized fluids within well 10 are prevented from escaping to the atmosphere. A circulating fluid removal conduit 34 having a shutoff valve 36 therein is sealingly connected to the top of casing string 18. Fluid circulated into well 10 through coiled tubing 26 is removed from the well through conduit 34 and valve 36 and routed to a pit, tank or other fluid accumulator.

Coiled tubing injector 12 is of a kind known in the art and functions to straighten coiled tubing 26 and inject it into well 10 through stuffing box 32 as previously mentioned. Coiled tubing injector 12 comprises a straightening mechanism 38 having a plurality of internal guide rollers 40 therein and a coiled tubing drive mechanism 42 which is used for inserting coiled tubing 26 into well 10, raising the coiled tubing or lowering it within the well, and removing the coiled tubing from the well as it is rewound on reel assembly 14. A depth measuring device 44 is connected to drive mechanism 42 and functions to continuously measure the length of coiled tubing 26 within the well 10 and provide that information to an electronic data acquisition system 46 which is part of reel assembly 14 through an electric transducer (not shown) and an electric cable 48.

Truck mounted reel assembly 14 includes a reel 50 on which coiled tubing 26 is wound. A guide wheel 52 is provided for guiding coiled tubing 26 on and off reel 50. A conduit assembly 54 is connected to the end of coiled tubing 26 on reel 50 by a swivel system (not shown). A shut-off valve 56 is disposed in conduit assembly 54, and the conduit assembly is connected to a fluid pump (now shown) which pumps fluid to be circulated from the pit, tank or other fluid communicator through the conduit assembly and into coiled tubing 26. A fluid pressure sensing device and transducer 58 is connected to conduit assembly 54 by connection 60, and the pressure sensing device is connected to data acquisition system 46 by an electric cable 62. As will be understood by those skilled in the art, data acquisition system 46 functions to continuously record the depth of coiled tubing 26 and joint locator 28 attached thereto in the well 10 and also to record the surface pressure of fluid being pumped through the coiled tubing and joint locator as will be further described herein.

Referring now to FIGS. 2A–2F, the details of joint locator 28 will be discussed. An outer housing 64 contains the other components of joint locator 28. At the upper end of outer housing 64 is a top sub 66 having a cylindrical first outer surface 68 which extends into a bore 70 of a makeup ring 72. A sealing means, such as a plurality of O-rings 74 provide sealing engagement between top sub 66 and makeup ring 72. To sub 66 defines a plurality of radially extending cylindrical recesses 76. A plurality of set screws 78 are threadingly engaged with makeup ring 72 and extend into corresponding recesses 76 to lock top sub 66 and makeup ring 72 together.

Outer housing 64 also comprises an upper housing 80 attached to makeup ring 72 by threaded connection 82. A sealing means, such as a pair of O-rings 84, provide sealing engagement between upper housing 80 and makeup ring 72.

Figure 2A:
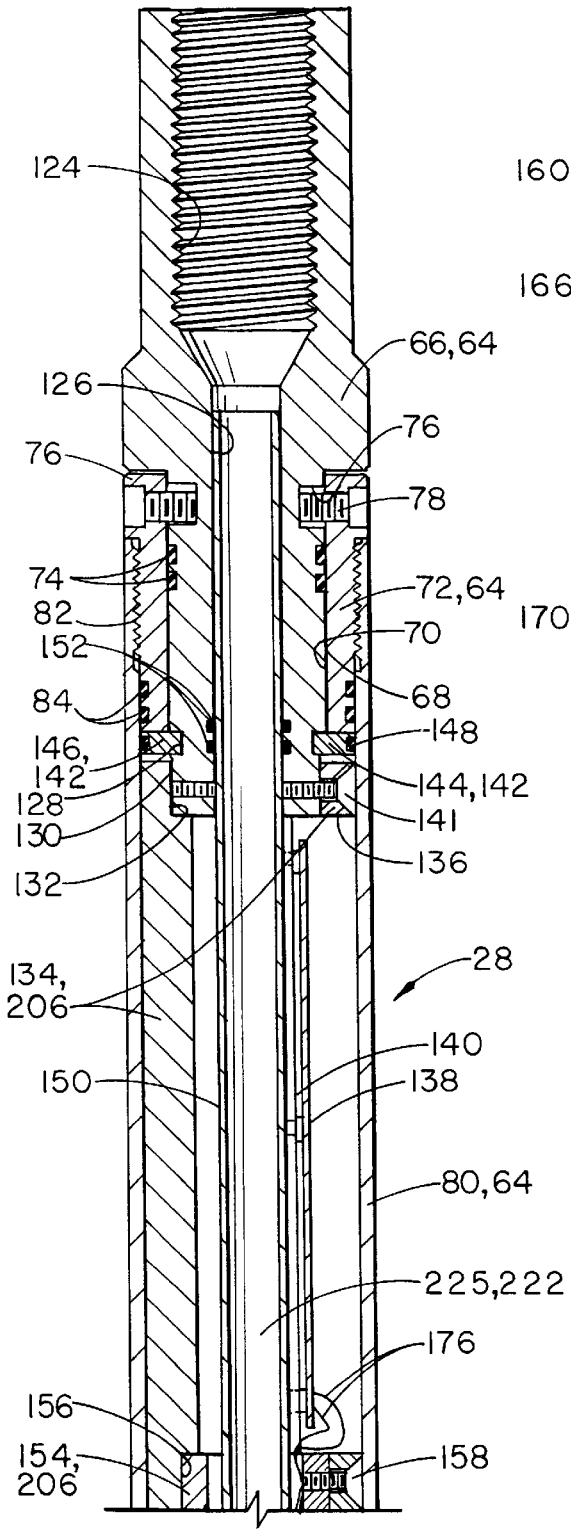
FIGS. 2A–2F show a longitudinal cross section of the coiled tubing joint locator.
Figure 2B:
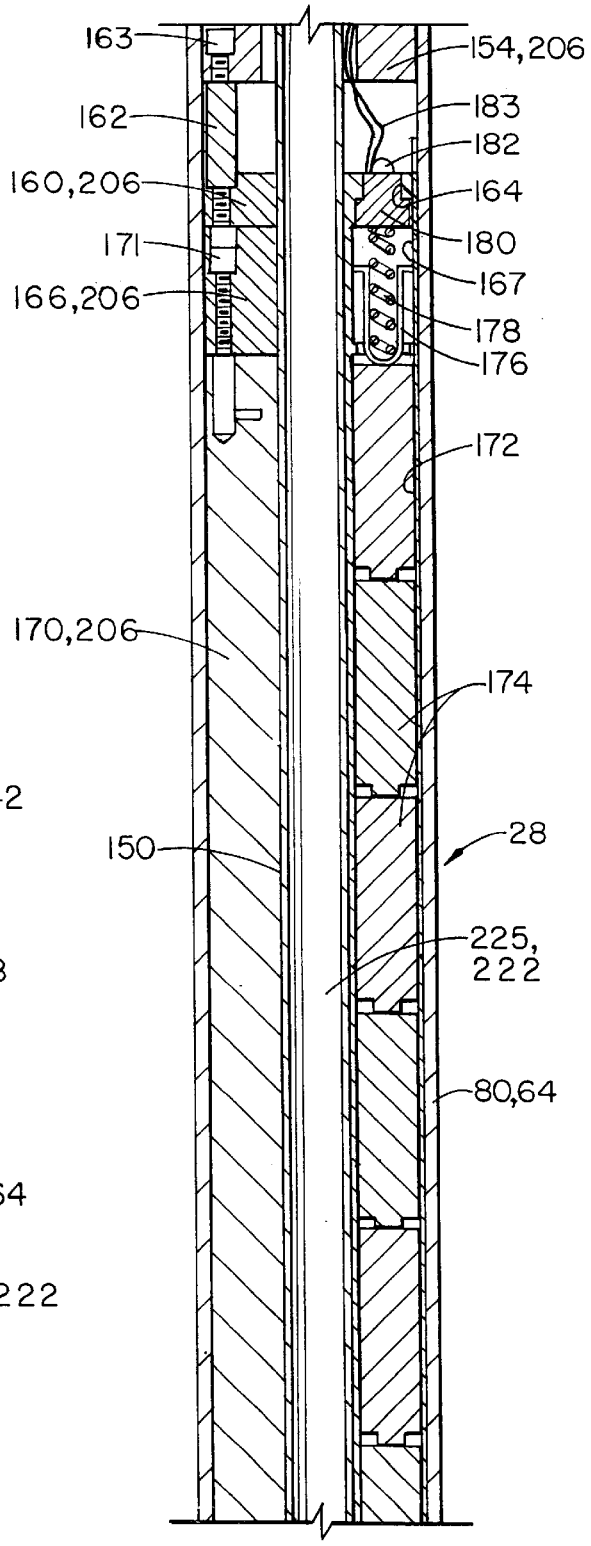
Figure 2C:
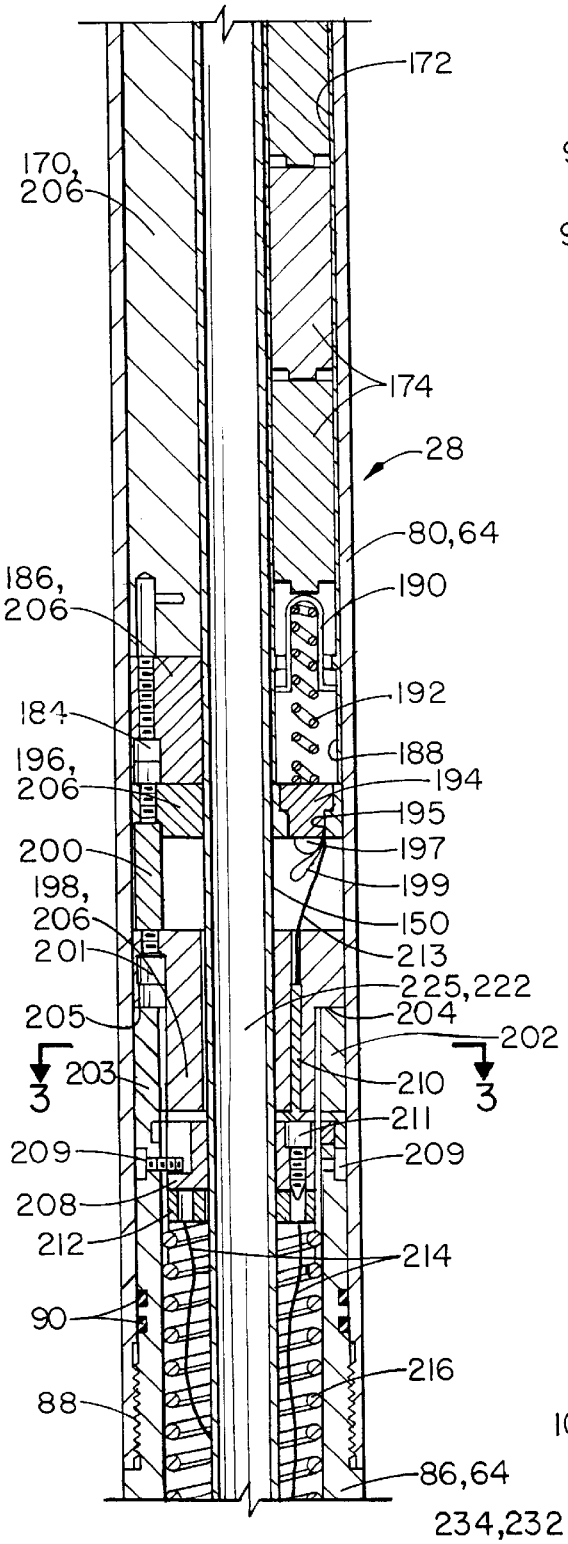

Referring to FIG. 2C, the lower end of upper housing 80 is attached to a middle sub 86 at threaded connection 88. A sealing means, such as a pair of O-rings 90, provide sealing engagement between upper housing 80 and middle sub 86.

Figure 2D:
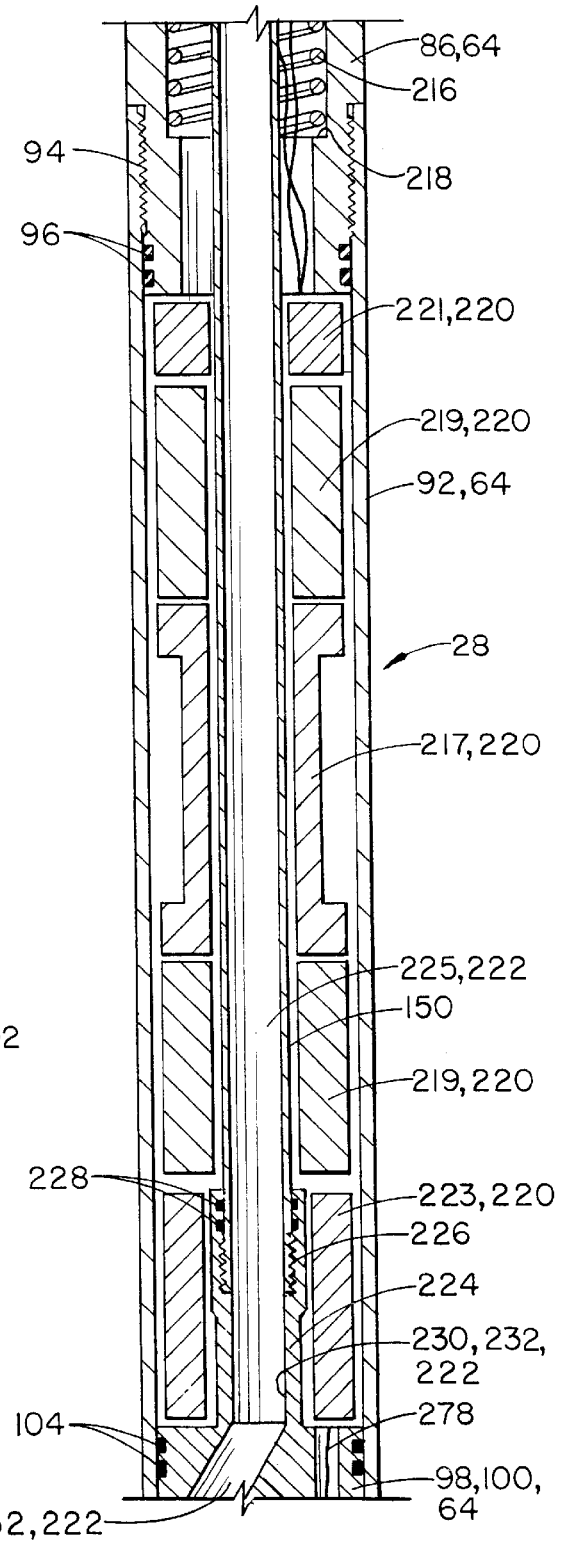

As seen in FIG. 2D, the lower end of middle sub 86 is attached to a coil housing 92 at threaded connection 94. A sealing means, such as a pair of O-rings 96, provide sealing engagement between middle sub 86 and coil housing 92. It will be seen that coil housing 92 forms another portion of outer housing 64.

Figure 2E:
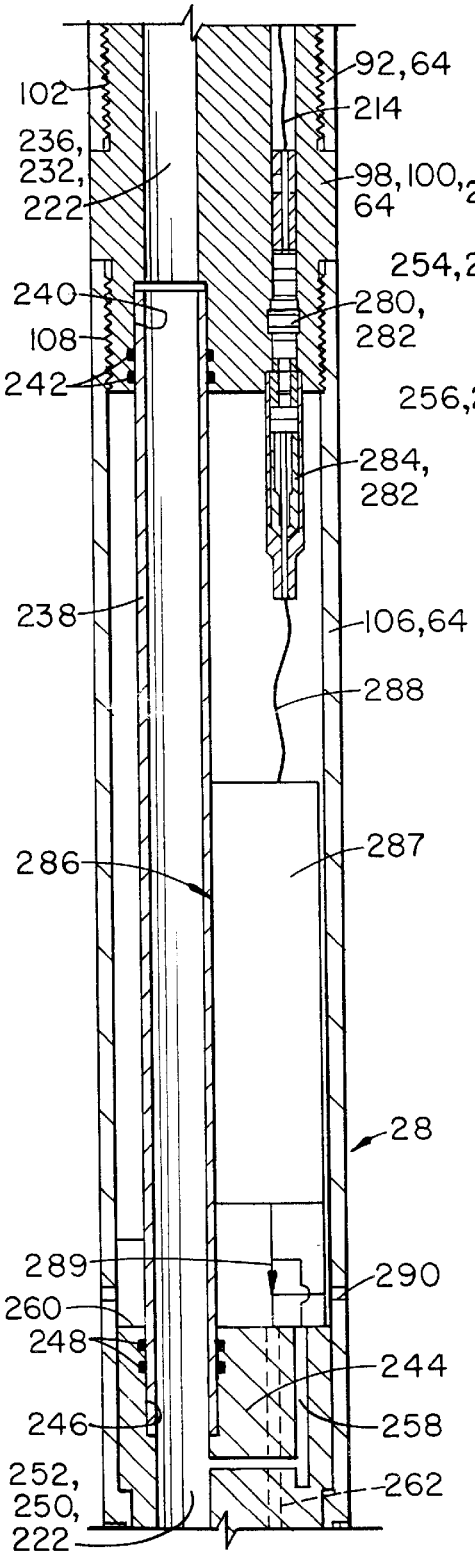

Outer housing 64 also includes a valve housing top sub 98 of a valve housing 100 which is connected to the lower end of coil housing 92 at threaded connection 102, as seen in FIG. 2E. Referring also to FIG. 2D, a sealing means, such as a pair of O-rings 104, provide sealing engagement between coil housing 92 and valve housing top sub 98.

Outer housing 64 also includes a middle housing 106 attached to the lower end of valve housing top sub 98 at threaded connection 108.

Figure 2F:
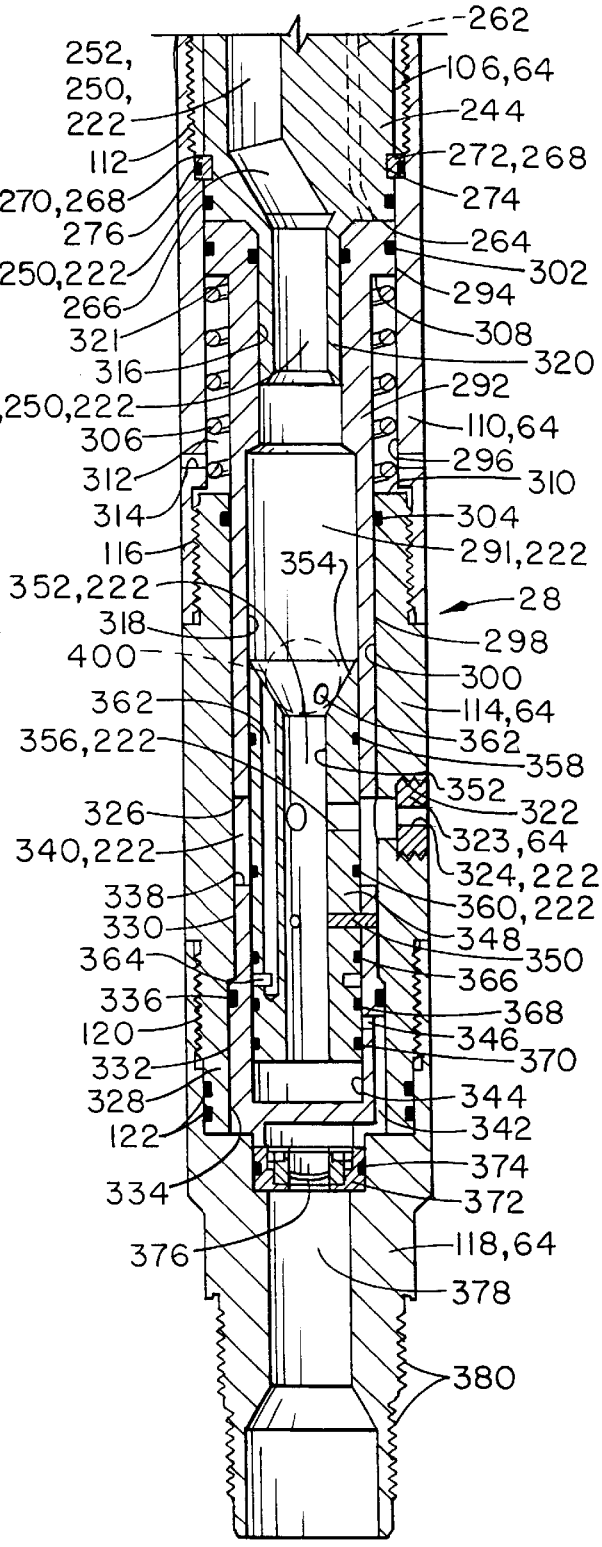

Referring now to FIG. 2F, the lower end of middle housing 106 is attached to a bottom housing 110, also forming a portion of outer housing 64, at threaded connection 112.

Bottom housing 110 is connected to a circulating sub 114 at threaded connection 116.

At the bottom of outer housing 64, a bottom sub 118 is attached to circulating sub 114 at threaded connection 120. A sealing means, such as a pair of O-rings 122, provides sealing engagement between circulating sub 114 and bottom sub 118.

Referring again to FIG. 2A, top sub 66 defines a threaded opening 124 therein adapted for connection to coiled tubing 16. Top sub 66 also defines a longitudinal bore 126 therethrough. An annular groove 128 is defined in first outer surface 68 of top sub 66.

A second outer surface 130 on the lower end of top sub 66 extends into a bore 132 in a printed circuit board (PCB) chassis 134. PCB chassis 134 defines a window 136 therein. An electric circuit means, such as a period circuit board (PCB) 138, is disposed in window 136 and is attached to surface 140 which extends longitudinally in PCB chassis 134 adjacent to window 136. A screw 141 is used to attach PCB chassis 134 to top sub 66. Screw 141 is off-center with respect to top sub 66.

A spilt ring assembly 142 is disposed in groove 128 in top sub 66. Split ring assembly 142 comprises a pair of split ring halves 144 and 146 with a retaining means, such as an O-ring 148, to hold the halves in groove 128. Split ring assembly 142 holds makeup ring 72 in engagement with top sub 66 and prevents longitudinal movement therebetween, while allowing relative rotation therebetween, during assembly of joint locator 28. That is, makeup ring 72 may be rotated with respect to top sub 66 to form threaded connection 82 between the makeup ring and upper housing 80 without requiring rotation of top sub or PCB chassis 134. After threaded connection 82 has been made up, set screws 78 are installed as previously described to lock top sub 66 and makeup ring 72 together so that the makeup ring cannot be rotated to disengage threaded connection 82.

The upper end of a top flow tube 150 is disposed in bore 126 in top sub 66. A sealing means, such as a pair of O-rings 152, provide sealing engagement between top sub 66 and top flow tube 150. Top flow tube 150 downwardly through upper housing 80, middle sub 86 and coil housing 92 of outer housing 64, as seen in FIGS. 2A–2D.

A top support collar 154 extends into a bore 156 at the lower end of PCB chassis 134. A plurality of screws 158 are used to attach top support collar 154 to PCB chassis 134.

An annular upper end cap 160 is spaced from top support collar 154 by a plurality of non-threaded standoffs 162. A plurality of screws 163 extend through standoffs 162 and are used to attach top support collar 154 to upper end cap 160. Upper end cap 160 has a plurality of openings 164 defined therein. Preferably, but not by way of limitation, there are four such openings 164 which are angularly spaced around upper end cap 160.

An upper spring housing 166 is disposed below and adjacent to upper end cap 160. Upper spring housing 166 defines a plurality of openings 167 therein which are aligned with openings 164 in upper end cap 160.

Disposed below upper spring housing 166 is a battery pack housing 170 defining a plurality of battery chambers 172 therein. Battery chambers 172 are aligned with corresponding openings 167 in upper spring housing 166 and openings 164 in upper end cap 160. An electric power source, such as a plurality of batteries 174, is disposed in each battery chamber 172. In the preferred embodiment, but not by way of limitation, there are four battery chambers 172 with eight batteries 174 each of which are AA size batteries.

A plurality of screws 171 connect upper spring housing 166 to battery pack housing 170.

An upper plunger 176 is disposed in each opening 167 in upper spring housing 166. Each upper plunger 174 is biased downwardly against an uppermost battery 174 by an upper spring 178 which is also engaged with an upper contact screw 180 disposed in each opening 164 of upper end cap 160. Another screw 182 connects upper contact screw 180 to a wire 183 which is connected to PCB 138.

Referring now to FIG. 2C, a plurality of screws 184 attach a lower spring housing 186 to the lower end of battery pack housing 170. Lower spring housing 186 defines a plurality of openings 188 therein which are aligned with corresponding battery chambers 172 in battery pack housing 170. A lower plunger 190 is slidably disposed in each opening 188 in lower spring housing 186. Each lower plunger 190 is biased upwardly against the lowermost battery 172 by a lower spring 192.

Lower spring 192 also engages a lower contact screw 194 positioned in an opening 195 defined in a lower end cap 196. Lower end cap 196 is adjacent to lower spring housing 186, and each opening 195 is aligned with a corresponding opening 188 in lower spring housing 186 and battery chamber 172 in battery pack housing 170.

Another screw 197 is used to attach a wire 199 to lower contact screw 194. Wire 199 is also connected to PCB 138.

A bottom support collar 198 is spaced from lower end cap 196 by a plurality of non-threaded standoffs 200. A plurality of screws 201 are used to attach bottom support collar 198 to lower end cap 196.

The lower end of bottom support collar 198 extends into the upper end of middle sub 86. Referring now to FIG. 3, fingers 202 and 203 extend upwardly from middle sub 86 into corresponding slots 204 and 205 in bottom support collar 198. Fingers 202 and 203 and slots 204 and 205 are different widths to uniquely orient bottom support collar 198 and middle sub 86 with respect to one another, as will be further described herein.

PCB chassis 134, top support collar 154, upper end cap 160, upper spring housing 166, battery pack housing 170, lower spring housing 186, lower end cap 196 and bottom support collar 198 form an electric case 206 which houses printed circuit board 138 and batteries 174. It will be seen that electric case 206, and the components therein, are easily removed from outer housing 64 by disconnecting top sub 66 and makeup ring 72 and sliding the assembly out over top flow tube 150. This provides easy battery replacement and facilitates replacement or reconfiguration of printed circuit board 138.

A probe contact insert 208 is disposed in the upper end of middle sub 86 below bottom support collar 198. A plurality of binderhead screws 209 lock probe contact insert 208 with respect to middle sub 86.

Four probes 210 are disposed through bottom support collar 198 and extend downwardly therefrom. Four probe contact screws 211, corresponding to probes 210, are threaded into probe contact insert 208. Each probe 210 is connected to a wire 213 which is also connected to PCB 138.

Two sets of probes 210, contact probes 211 and wires 213 provide a connection between PCB 138 and an electromagnetic coil assembly 220, and another two sets provide a connection between PCB 138 and a solenoid valve 286, as further described herein.

A back cap 212 is disposed adjacent to probe contact insert 208, and the lower end of probe contact screws 211 extend slightly into back cap 212. Each probe contact screw 211 is in electrical contact with a wire 214. Two wires 214 extend down to electromagnetic coil assembly 220, and two wires 214 extend down toward solenoid valve 286.

Referring also to FIG. 2D, a spring 216 is positioned between back cap 212 and a shoulder 218 in middle sub 86 to provide a biasing means for biasing back cap 212 and probe contact insert 208 upwardly. It will be seen by those skilled in the art that this keeps each probe contact screw 211 in electrical contact with the corresponding probe 210. Because of the difference in the widths of fingers 202 and 203 on middle sub 86 which engage corresponding slots 204 and 205 in bottom support collar 198, it will be seen that each probe 210 is aligned and kept in contact with a specifically corresponding probe contact screw 211. In this way, the proper electrical connection is made between PCB 138 and electromagnetic coil assembly 220 and also with solenoid valve 286.

Electromagnetic coil assembly 220 is positioned in coil housing 92 below middle sub 86. Electromagnetic coil assembly 220 is of a kind generally known in the art having a coil 217, magnets 219 and rubber shock absorbers 221 and 223.

As seen in FIGS. 2A–2D, top flow tube 150 extends downwardly through outer housing 64. Top flow tube 150 has a central opening 225 which forms a portion of a flow passageway 222 in joint locator 28 which extends through PCB chassis 134, top support collar 154, upper end cap 160, upper spring housing 166, battery pack housing 180, lower spring housing 186, lower end cap 196, bottom support collar 198, probe contact insert 208, back cap 212, middle sub 86 and electromagnetic coil assembly 220.

The lower end of top flow tube 150 is attached to a top neck portion 224 of valve housing top sub 98 by threaded connection 226. A sealing means, such as a pair of O-rings 228, provides sealing engagement between top flow tube 150 and top neck portion 224.

Top neck portion 224 defines a bore 230 therein which may be referred to as an upper portion 230 of a sub passageway 232 in valve housing top sub 98. Sub passageway 232 is part of flow passageway 222 and will be seen to be in communication with central opening 221 in top flow tube 150. In addition to upper portion 230 in top neck portion 224, sub passageway 232 has an angularly disposed central portion 234, seen in FIG. 2D, and a longitudinally extending lower portion 236, seen in FIG. 2E. Thus, lower portion 236 of sub passageway 232 is off center with respect to upper portion 230 and the central axis of joint locator 28.

A valve housing flow tube 238, also referred to as a bottom flow tube 238 extends into a bore 240 at the lower end of lower portion 236 of sub passageway 232 in valve housing top sub 98. A sealing means, such as a pair of O-rings 242, provides sealing engagement between bottom flow tube 238 and valve housing top sub 98. The lower end of bottom flow tube 238 extends into a bore 246 in a valve housing bottom sub 244. A sealing means, such as a pair of O-rings 248, provides sealing engagement between bottom flow tube 238 and valve housing bottom sub 244.

Referring to FIGS. 2E and 2F, valve housing bottom sub 244 has a sub passageway 250 defined therein which forms part of flow passageway 222. Sub passageway 250 has a substantially longitudinally extending upper portion 252, an angularly disposed central portion 254, and a substantially longitudinally extending lower portion 256. Upper portion 252 of sub passageway 250 is offset from the central axis of joint locator 28, and lower portion 256 is on the central axis.

Valve housing bottom sub 244 has a passageway port 258 extending between upper portion 252 of passageway 250 and top surface 260 of the valve housing bottom sub, as seen in FIG. 2E. Valve housing bottom sub 244 also has a piston port 262 extending between top surface 260 and a downwardly facing shoulder 264 as seen in FIGS. 2E and 2F.

A sealing means, such as an O-ring 266, provides sealing engagement between valve housing bottom sub 244 and bottom housing 110, as seen in FIG. 2F. A bottom sub split ring assembly 268 having two split ring halves 270 and 272 fits in a groove 274 defined on the outside of valve housing bottom sub 244. It will be seen by those skilled in the art that split ring assembly 268 thus acts to lock valve housing bottom sub 244 with respect to middle housing 106 when threaded connection 112 is made up. An O-ring 276 holds halves 270 and 272 of split ring 268 in groove 274 during assembly.

Referring again to FIGS. 2D and 2E, one of wires 214 is shown extending downwardly through valve housing top sub 98. Wire 214 is connected to an upper portion 280 of a socket connector 282. Socket connector 282 also has a lower portion 284 which is connected to pilot solenoid valve 286 by a wire 288. Another set of wires 214, 288 and socket connector 282 (not shown) also connect PCB 138 to solenoid valve 286.

Solenoid valve 286 is disposed in middle housing 106 on top surface 260 of valve housing bottom sub 244. As will be further described herein, solenoid valve 286, which is schematically shown in FIG. 2E, is of a kind known in the art having an electric solenoid 286 which actuates a valve portion 289. Solenoid valve 286 is configured and positioned so that when it is in a closed position, communication between passageway port 258 and piston port 262 is valve housing bottom sub 244 is prevented, and the solenoid valve is vented to the well annulus through a transverse annulus or vent port 290 in middle housing 106. When solenoid valve 286 is in the open position, passageway port 258 and piston port 262 are placed in communication with one another and the solenoid valve is no longer in communication with vent port 290. Passageway port 258 and piston port 262 when in communication with one another may be said to form a pilot passageway 258,262.

Below shoulder 264 on valve housing bottom sub 244, a piston 292 is slidably disposed in bottom housing 110 and circulating sub 114. Piston 292 has a first outside diameter 294 which fits within a bore 296 in bottom housing 110 and a smaller second outside diameter 298 which fits within first bore 300 in circulating sub 114. A sealing means, such as O-ring 302, provides sealing engagement between piston 292 and bottom housing 110, and another sealing means, such as O-ring 304, provides sealing engagement between the piston and circulating sub 114. A biasing means, such as spring 306 is positioned between a downwardly facing shoulder 308 on piston 292 and an upper end 310 of circulating sub 114. Spring 30 biases piston 292 upwardly toward shoulder 264 on valve housing bottom sub 244. Spring 306 is thus positioned in a spring chamber 312, and a transverse port 314 is defined in bottom housing 110 to equalize the pressure between spring chamber 312 and the well annulus outside joint locator 28. It will be seen by those skilled in the art that well annulus pressure thus is applied to the area of shoulder 308 on piston 292.

It will also be seen that the top of piston 292 is in communication with piston port 262 in valve housing bottom sub 244.

Piston 292 has a central opening 291 defined by a first bore 316 therein and a larger second bore 318. Central opening 291 is part of flow passageway 222. A bottom neck portion 320 of valve housing bottom sub 244 extends into first bore 316 of piston 292. Thus, sub passageway 250 is in communication with central opening 291 of piston 292. A sealing means, such as an O-ring 321, provides sealing engagement between piston 292 and bottom neck portion 320.

Circulating sub 111 defines a threaded port 322 extending transversely therein. A nozzle 323 is threaded into port 322 and defines a circulating port 324 therein. Nozzle 323 may be said to be part of outer housing 64 such that circulating port 324 may be said to extend transversely in the outer housing. Nozzle 323 in one of a plurality of interchangeable nozzles with differently sized circulating ports 324. Thus, circulating port 324 may be said to be variably sized. In the position of piston 292 shown in FIG. 2F, a lower end 326 of the piston is disposed above circulating port 324. When open, circulating port 324 is an outlet portion of flow passageway 222.

A seat body 328 is disposed in circulating sub 114. Seat body 328 has first outside diameter 330 sized to fit within first bore 300 of circulating sub 114 and a larger second outside diameter 332 sized to fit within second bore 334 of circulating sub 114. A sealing means, such as an O-ring 336, provides sealing engagement between seat body 328 and circulating sub 114. An upper end 338 of seat body 328 is below circulating port 324. Thus, an annular volume 340 is defined between lower end 326 of piston 292 and upper end 338 of seat body 328, and this annular volume is part of flow passageway 222 and is in communication with circulating port 324.

Seat body 328 defines a body passageway 342 on the outside thereof which is in communication with bore 344 is seat body 328 through a transversely extending body port 346.

A seat sleeve 348 is slidably disposed in second bore 318 of piston 292 and bore 344 in seat body 328. Seat sleeve 348 is initially shearably attached to seat body 328 by a shearing means such as a shear pin 350.

Seat sleeve 348 defines a central opening 352 therethrough, forming part of flow passageway 222, with a chamfered seat 354 at the upper end thereof. A transversely extending port 356, also part of flow passageway 222, is defined in seat sleeve 348. Port 356 provides communication between central opening 352 and annular volume 340 when in the position shown in FIG. 2F.

A sealing means, such as an O-ring 358, provides sealing engagement between seat sleeve 348 and piston 292 above port 356, and another sealing means, such as O-ring 360, is disposed on seat sleeve 348 below port 356. In the initial position shown in FIG. 2F, O-ring 360 is in communication with annular volume 340. O-ring 360 is not used for sealing until piston 292 is moved, as will be further described herein.

Seat sleeve 348 also defines a plurality of longitudinally extending flow ports 362 therein which are spaced radially outwardly from central opening 352. The upper ends of flow ports 362 are located in chamfered set 354, and the lower ends of the flow ports are in communication with an annular recess 364 defined in the outside of seat sleeve 348. A sealing means, such as O-ring 366, provides sealing engagement between seat sleeve 348 and seat body 328 above recess 364, and another sealing means, such as O-ring 368, provides sealing engagement between the seal sleeve and seat body below recess 364. O-ring 368 is disposed above transverse port 346, and an additional sealing means, such as O-ring 370, provides sealing engagement between seat sleeve 348 and seat body 328 below port 346 when the seat sleeve is in the position shown in FIG. 2F.

Below seat body 328, a rupture disk housing 372 is disposed in bottom sub 118, and a sealing means, such as O-ring 374, provides sealing engagement between rupture disk housing 372 and bottom sub 118. A rupture disk 376 is disposed in rupture disk housing 372. The upper side of rupture disk 376 will be seen to be in communication with body passageway 342 in seat body 328, and the lower side of rupture disk 376 is in communication with a central opening 378 in bottom sub 118.

Bottom sub 118 has a threaded outer surface 380 adapted for connection to well tool 30 below joint locator 328.

The presently preferred embodiment of joint locator 28 shown in FIGS. 2A–2F has a generally modular construction. Starting with the uppermost, the modules include as major components PCB 138, battery pack housing 170 and batteries 174, electromagnetic coil assembly 220, solenoid valve 286, seat sleeve 348 and rupture disk 376, along with the various components associated with each of these main items. It will be understood by those skilled in the art that with minor modifications, these modules and their major components can be rearranged and repositioned as desired. The invention is not intended to be limited to the exact relationship between the modules shown in FIGS. 2A–2F.

OPERATION OF THE FIRST EMBODIMENT

In operation, first embodiment joint locator 28 is attached to coiled tubing 26 at threaded opening 124 as previously described, and a well tool 30 is connected below joint locator 28. Coiled tubing 26 is injected into well 10 and may be raised within the well using injector 12 in the known manner with corresponding movement of joint locator 28. Thus, joint locator 28 may be raised and lowered within production tubing string 20. As joint locator 28 passes through a pipe joint 24, electromagnetic coil assembly 220 senses the increased mass of the pipe joint.

Figure 4:
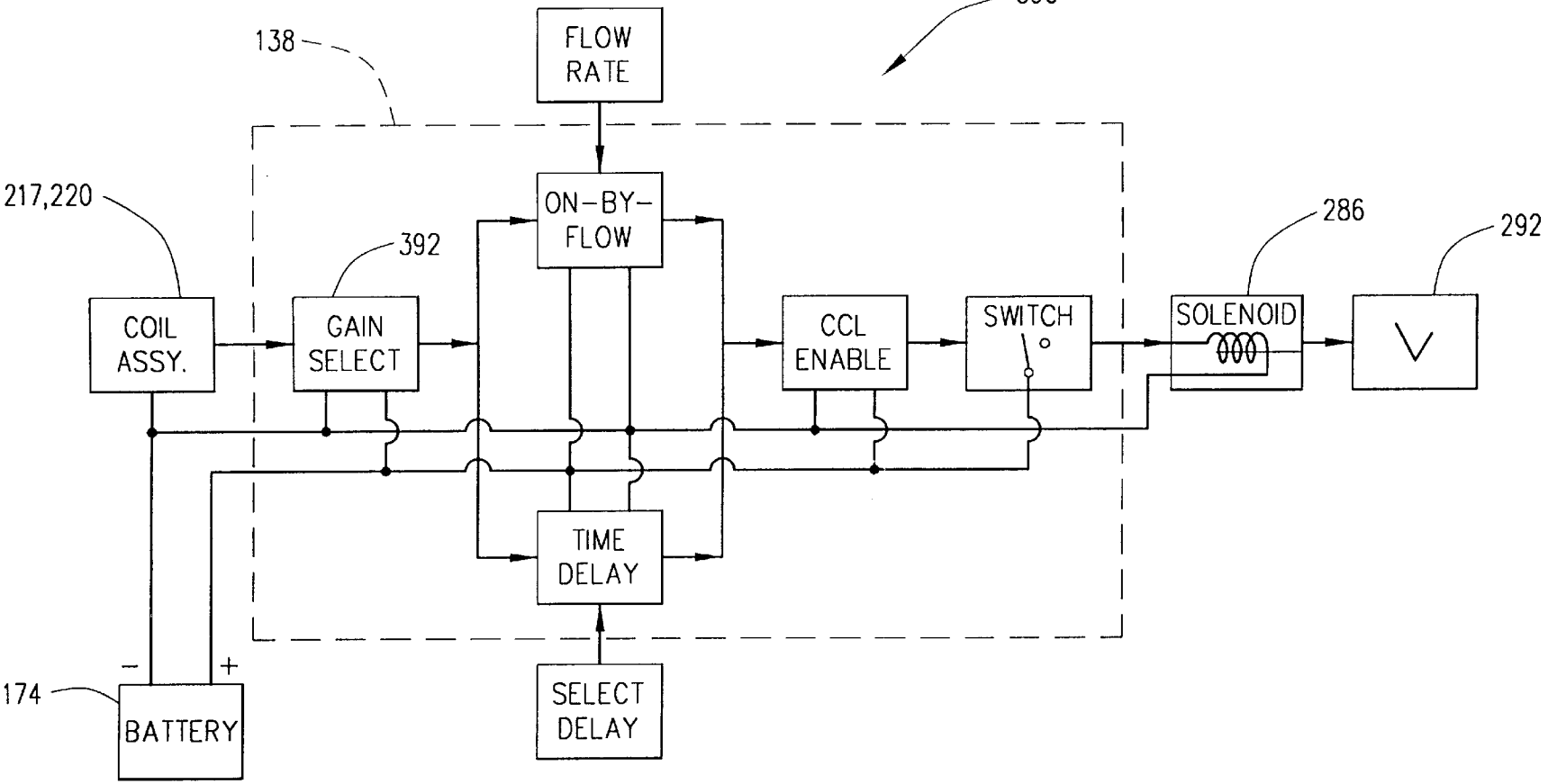
FIG. 4 shows a flow chart of the control circuitry used in one embodiment of the joint locator.

Referring to FIG. 4, a flow chart of an electrical circuit 390 for joint locator 28 is shown and will be understood by those skilled in the art. Most of electrical circuit 390 is on printed circuit board 138. Power for circuit 390 is provided by batteries 174, and coil assembly 220 and solenoid valve 286 are also part of the circuit.

To minimize the consumption of power, circuit 390 includes a time delay 392. Any of a variety of time delay periods may be preselected when joint locator 28 is being made up, and the selected time delay period prevents operation of solenoid 286 before the time delay period has lapsed. This prevents unnecessary actuation of solenoid valve 286 as joint locator 28 is moved in tubing string 20 to the desired location. The deeper the joint locator 28 is going to be used in well 10, the longer the time delay period selected in time delay 392. Time delay 392 also has a fixed time period before deactivating solenoid valve 286 so that joint locator 28 may be tested after assembly to allow a tool functionality check before the joint locator is lowered into well 10. Once the fixed test period lapses, time delay 392 activates the preselected time period to prevent actuation of solenoid valve 286 until lapsing of that time delay period.

A test time period is also provided in time delay 392 to allow testing of joint locator 28 before the above-described time delay starts.

As joint locator 28 passes through a pipe joint 24, electromagnetic coil assembly 220 electromagnetically senses the increased mass of the pipe joint and provides a signal to circuitry on printed circuit board 138. That is, a voltage pulse is induced in coil 217 and sent a PCB 138. This voltage pulse, if sufficiently large in amplitude, signals the PCB circuitry that it is time to provide battery power to solenoid valve 286. Once battery power is supplied to solenoid valve 286, valve portion 289 is actuated by electric solenoid 287 to place passageway port 258 in communication with piston port 262 in valve housing bottom sub 244. In a preferred embodiment, this power is applied to solenoid valve 286 for a period of approximately 2.9 seconds which is a function of resistor and capacitor values in circuit 390.

The "Gain Select" circuitry is simply for signal amplification in the event that the voltage induced in coil 217 is too small for detection or too large to discriminate noise from actual casing collars.

The "CCL Enable" is a time delay circuit designed to minimize power drain from batteries 174 when running apparatus 10 to logging depth. A time delay may be preselected from a plurality of time delay values during which the battery power will not be applied to solenoid valve 286. In the preferred embodiment, but not by way of limitation, time delay periods of ten, twenty, forty, eighty or one hundred sixty minutes may be chosen. After this time delay, the power from batteries 174 back to PCB 138 may be at any time supplied to solenoid valve 286 if a sufficiently large voltage pulse from coil 217 is detected as previously described.

The "On-By-Flow" circuitry is for an alternate embodiment in which power from batteries 174 may be supplied to solenoid valve 286 only when a minimum flow volume is being pumped at the surface at the time coil 217 detects a collar.

Thus, an electronic means is provided for detecting the increased mass of the pipe joint and placing the ports in communication. It will be seen that the actuation of solenoid valve 286 briefly places fluid pressure in the flow passageway 222 through joint locator 28 in communication with the top of piston 292 in bottom housing 110 and circulating sub 114. Because the pressure in spring chamber 312 is at annulus pressure, the higher internal pressure in flow passageway 222 in joint locator 28 applied to the top of piston 292 forces the piston downwardly such that it acts as a valve means for closing circulating port 324 in circulating sub 114. This causes a surface detectable pressure increase in the fluid in joint locator 28, because the fluid may no longer flow through circulating port 324. When solenoid valve 286 recloses, spring 306 returns piston 292 to its open position, again allowing fluid flow through flow passageway 222 and out circulating port 324.

The operator will know the depth of joint locator 28 and thus be able to determine the depth of the pipe joint just detected. It will be understood by those skilled in the art that joint locator 28 may also be configured such that circulating port 324 is normally closed and the momentary actuation of piston 292 by solenoid valve 286 may be used to open the circulating port. In this configuration, the pipe joint is detected by a surface detectable drop in the fluid pressure. The configurations shown in FIGS. 2A through 2F is preferable when it is desired to circulate fluid while positioning joint locator 28.

This process for detecting the location of pipe joints may be repeated as many times as desired to locate any number of pipe joints 24. The only real limitation in this procedure is the life of batteries 184.

Rupture disk 376 is provided to prevent communication of fluid pressure to any well tool 30 below joint locator 28 until sufficient pressure has been applied to rupture the rupture disk as will be further described herein.

Referring to FIG. 2F, seat sleeve 348 is shown in the initial, run-in position. It will be seen that fluid may be circulated through flow passageway 222 in joint locator 28 and out circulating ports 324 because port 356 in seat sleeve provides communication between circulating port 324 and central opening 352 in the seat sleeve, as previously described. It will also be seen that port 346, and thus body passageway 342 are closed so that fluid pressure flow passageway 222 cannot be applied to rupture disk 376. This prevents premature rupturing of rupture disk 376 and the resultant premature actuation of well tool 30.

Once the desired number of pipe joints 24 have been located using joint locator 28 in the manner previously described, seat sleeve 348 may be actuated by dropping a ball 400 through coiled tubing 26 and joint locator 28. Ball 400 is sized so that it will pass through flow passageway 222 in joint locator 28 until it engages chamfered seat 354 at the top of seat sleeve 348. Ball 400 is sized so that it will not pass into central opening 352 in seat sleeve 348, and thus, the ball prevents further circulation of fluid out of joint locator 28 because circulating port 324 is effectively closed. Fluid pressure then applied to seat sleeve 348 and ball 400 forces the seat sleeve downwardly, shearing shear pin 350. Seat sleeve 348 is thus moved downwardly until recess 364 therein is aligned with port 346 in seat body 328. Thus, flow ports 362 in seat sleeve 348 are placed in communication with body passageway 342 in seat body 328. This places rupture disk 376 in communication with the flow passageway 222 in joint locator 28, and by applying sufficient pressure to rupture the rupture disk, flow passageway 222 is placed in communication with well tool 30 so that well tool 30 may be used in its prescribed manner. Thus, seat sleeve 348 and rupture disk 376 may be said to provide a pressure isolation means for preventing premature communication between the pressure in coiled tubing 26 and any tool 30 positioned below joint locator 28.

SECOND EMBODIMENT

Figure 5:
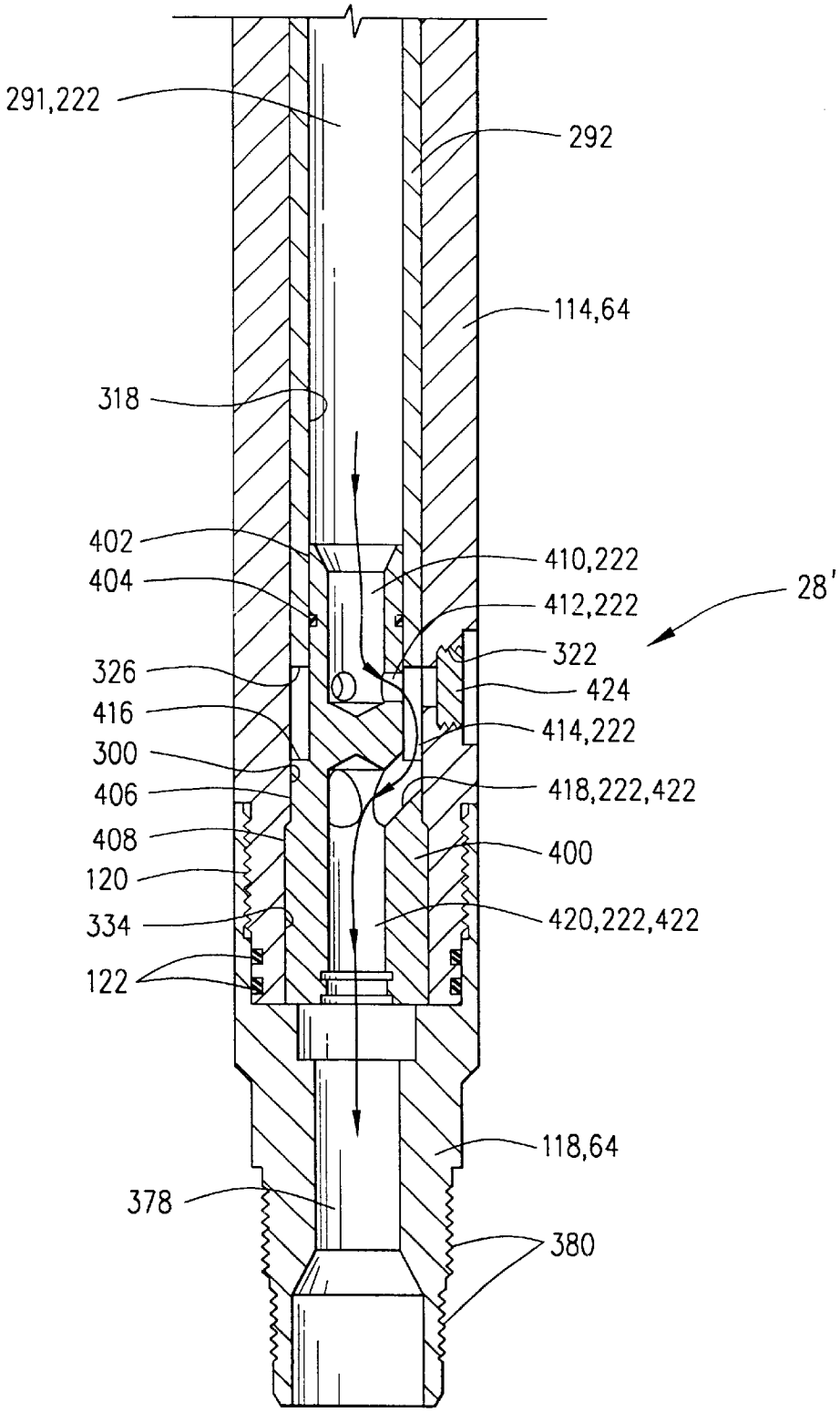
FIG. 5 shows a cross section of a lower portion of a second embodiment of the joint locator of the present invention.
Figure 5:
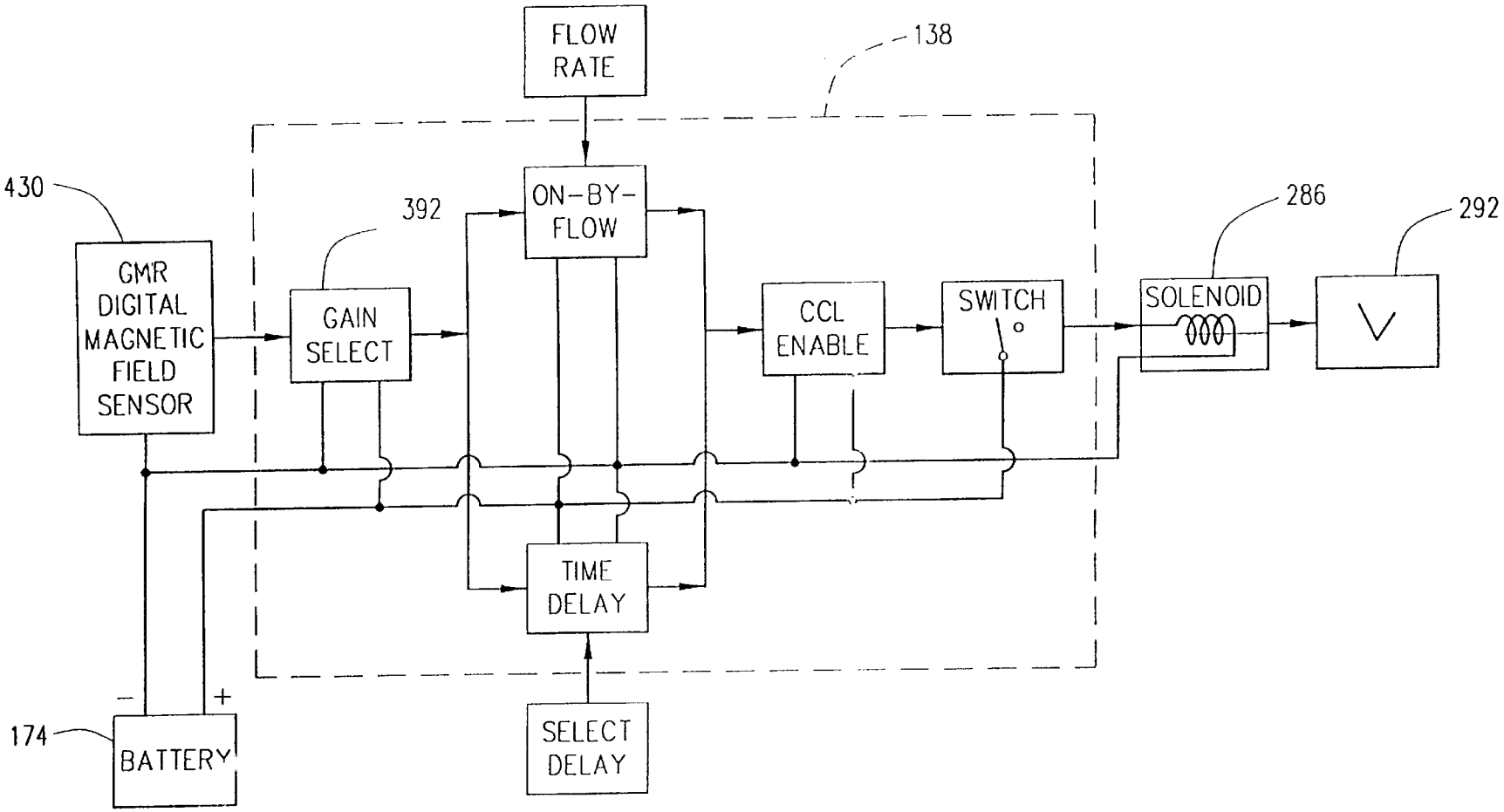

Referring now to FIG. 5, second embodiment joint locator 28' is shown. Second embodiment joint locator 28' includes the same outer housing 64 of first embodiment joint locator 28. At the lower end thereof, shown in FIG. 5, outer housing 64 thus again comprises circulating sub 114 attached to a bottom sub 118 at threaded connection 120. O-rings 122 provide sealing engagement therebetween.

An insert 400 is disposed in circulating sub 114. Insert 400 has a first outside diameter 402 sized to fit within second bore 318 of piston 292. A sealing means, such as an O-ring 404, provides sealing engagement between insert 400 and piston 292. Insert 400 also includes a second outside diameter 406 sized to fit within first bore 300 of circulating sub 114 and a larger third outside diameter 408 sized to fit within second bore 334 of circulating sub 114.

Insert 400 defines an upper central opening 410 therethrough, forming part of flow passageway 222. One or more transversely extending ports 412, also part of flow passageway 222, are defined in insert 400. Ports 412 provide communication between upper central opening 410 and an annular volume 414 defined between lower end 326 of piston 292 and an upwardly facing shoulder 416 on insert 400 which extends between first outside diameter 402 and second outside diameter 406 thereof. Annular volume 414 also forms a part of flow passageway 222.

Insert 400 further defines an angled port 418 which provides communication between annular volume 414 and a lower central opening 420. Lower central opening 420 is in communication with central opening 378 in bottom sub 118. Central opening 378 may also be described as a circulation port 378 in second embodiment joint locator 28' because port 322 is closed by a plug 424.

Angled port 418 and lower central opening 420 in insert 400 and circulation port 378 provide a longitudinal or axial flow conduit 422 through the lower end of second embodiment joint locator 28'. Flow conduit 422, of course, forms a portion of overall flow passageway 222.

OPERATION OF THE SECOND EMBODIMENT

In operation, second embodiment joint locator 28' is attached to coiled tubing 26 at threaded opening 124 as previously described for first embodiment joint locator 28. As with the first embodiment, coiled tubing 26 is injected into well 10 and may be raised within the well using injector 12 with corresponding movement of joint locator 28'. Thus, second embodiment joint locator 28' may be raised and lowered within production tubing 20. As joint locator 28' passes through a pipe joint 24, electromagnetic coil assembly 220 senses the increased mass of the pipe joint.

As joint locator 28' is injected into well 10, fluid may be circulated through coiled tubing 26 and flow passageway 222, flow conduit 422 and circulation port 378.

As with first embodiment joint locator 28, electromagnetic coil assembly 220 electromagnetically senses the increased mass of a pipe joint and provides a signal to circuitry on printed circuit board 138. This actuates solenoid valve 286. A time delay may be preselected as previously described. Actuation of solenoid valve 286 briefly places fluid pressure in flow passageway 222 through joint locator 28' in communication with the top of piston 292 and bottom housing 110 in circulating sub 114. Because the pressure in spring chamber 312 is at annulus pressure, the higher internal pressure in flow passageway 222 in joint locator 28' applied to the top of piston 292 forces the piston downwardly such that it acts as a valve means for closing flow passageway 222 and flow conduit 422. This causes a surface detectable pressure increase in the fluid in joint locator 28', because the fluid may no longer flow through flow conduit 422 and circulation port 378. When solenoid valve 286 recloses, spring 306 returns piston 292 to its open position, again allowing fluid flow through flow passageway 222 and flow passageway 422.

This process may be repeated as desired to locate any number of pipe joints 24.

With first embodiment joint locator 28, no fluid flow is allowed to pass longitudinally through the joint locator until after dropping ball 400. Circulation port 324 is transversely disposed. Because fluid flow is directed out transverse circulating port 324 in first embodiment joint locator 28 during logging operations, washing operations through the bottom of joint locator 28 are not possible. This prevents first embodiment joint locator 28 from being used for washing operations until after all logging passes are complete. Further, after ball 400 is dropped and flow is established through joint locator 28 by rupturing rupture disk 376, no more logging operations are possible.

In second embodiment joint locator 28', insert 400 allows for flow axially or longitudinally through the joint locator and out longitudinal circulating port 378 during both logging operations and circulating. This also allows the tool to be used for washing or circulating fluids at the same time logging operations are being performed. No ball is necessary at any time. Insert 400 thus allows for alternately logging or washing, and the operator can switch back and forth between these operations whenever desired.

ALTERNATE ELECTRONIC MASS SENSOR

Referring now to FIG. 2A, an alternate electric sensing means for sensing the increased mass of a casing joint is shown in phantom lines and generally designated by the numeral 430. This mass sensor 430 incorporates a device known as a giant magnetoresistive digital field sensor, also referred to as a gradiometer, such as the GMR digital magnetic field sensor, AD series and AB001 series, manufactured by Nonvolatile Electronics, Inc., of Eden Prairie, Minn. This device can sense the increased mass of a pipe joint as the joint locator is run into a wellbore and provide a signal to the circuitry on circuit board 138 in a manner similar to electromagnetic coil assembly 220. The GMR digital magnetic field sensor, however, is considerably smaller, and can be included as a component on circuit board 138. This eliminates the need for coil 217 and magnets 219 which form electromagnetic coil assembly 220, as well as rubber shock absorbers 221 and 223. This allows the elimination of coil housing 92 of outer housing 64. Of course, this reduces the size, weight and cost of the joint locator.

This alternate mass sensor 430 can be incorporated into either first embodiment joint locator 28 or second embodiment joint locator 28'.

FIG. 6 illustrates a flow chart for the apparatus including the GMR digital magnetic field sensor instead of electromagnetic coil assembly 220.

It will be seen, therefore, that the wireless coiled tubing joint locator of the present invention is well adapted to carry out the ends and advantages mentioned, as well as those inherent therein. While presently preferred embodiments of the apparatus have been described for the purposes of this disclosure, numerous changes in the arrangement and construction of parts may be made by those skilled in the art. All such changes are encompassed within the spirit and scope of the appended claims.

What is claimed is:

1. A well pipe string joint locator for use in a pipe string, said locator comprising:

a housing having an upper end adapted for connection to a length of coiled tubing whereby the locator may be moved within the pipe string in response to movement of the coiled tubing, said housing defining a central opening therethrough and a circulation port in communication with said central opening;

a valve disposed in said housing for momentarily opening and closing said circulation port in response to a pressure differential between the coiled tubing and a well annulus outside said housing; and an electronic means disposed in said housing for detecting an increased mass of a pipe joint and generating a momentary electric output signal in response thereto and placing said valve in communication with the pressure in the coiled tubing in response to said signal.

2. The locator of claim 1 wherein said electronic means comprises a pilot solenoid which opens in response to said signal and thereby places said valve in communication with the pressure in the coiled tubing.

3. The locator of claim 2 wherein said housing defines:

a pilot passageway therein in communication with an upper portion of said valve; and an annulus port in communication with a lower portion of said valve;

wherein, said pilot solenoid is adapted to open said pilot passageway in response to said signal.

4. The locator of claim 2 wherein said pilot solenoid is spaced from a longitudinal axis of said housing.

5. The locator of claim 2 further comprising:

a power supply for providing power to said pilot solenoid; and a time delay circuit for preventing power from being communicated from said power supply to said pilot solenoid until after a preselected time delay.

6. The locator of claim 5 wherein said time delay circuit provides a test time period for allowing testing of the joint locator prior to initiation of said time delay.

7. The locator of claim 1 wherein said electronic means comprises:

an electromagnetic coil and magnet for electromagnetically sensing the increased mass of the pipe joint.

8. The locator of claim 7 wherein said electronic means further comprises:

an electric power source; and an electric circuit means for generating said signal when said coil electromagnetically senses said increased mass.

9. The locator of claim 8 further comprising:

an electric case in which said power source and electric circuit means are disposed, said case being removable from said housing.

10. The locator of claim 9 wherein said case is threadingly connected to an upper end of said housing.

11. The locator of claim 1 wherein said electronic sensor means comprises a giant magnetoresistive field gradient sensor for electromagnetically sensing the increased mass of the pipe joint.

12. The locator of claim 11 wherein said electronic means further comprises:

an electric power source; and an electric circuit means for generating said signal when said sensor electromagnetically senses said increased mass.

13. The locator of claim 12 further comprising:

an electric case in which said power source, said electric circuit means and said sensor are disposed, said case being removable from said housing.

14. The apparatus of claim 13 wherein said case is threadingly connected to an upper end of said housing.

15. The locator of claim 1 further comprising:

pressure isolation means for preventing premature communication between the pressure in the coiled tubing and a bottom portion of said housing below said circulation port.

16. The locator of claim 15 wherein said pressure isolation means comprises a rupture disk.

17. The locator of claim 15 wherein said pressure isolation means comprises:

a valve having a seat thereon and a flow passageway therethrough, said valve having a closed position wherein flow through said passageway is prevented and an open position wherein flow through said passageway is allowed; and a ball engagable with said seat such that fluid communication through said circulation port is prevented and when a predetermined pressure is applied to said valve and ball, said valve is moved from said closed position to said open position thereof.

18. The locator of claim 17 wherein said valve comprises:

a seat body fixedly disposed in said housing and forming a lower portion of said flow passageway; and a seat sleeve slidably disposed in said seat body and forming an upper portion of said flow passageway, said upper portion of said passageway being in communication with said lower portion of said passageway when said valve is in said open position thereof.

19. The locator of claim 18 wherein said valve further comprises shear means for initially shearably holding said seat sleeve in said closed position thereof.

20. The locator of claim 17 wherein said pressure isolation means further comprises a rupture disk disposed below said valve.

21. The locator of claim 1 wherein said circulation port is transversely disposed in said housing.

22. The locator of claim 1 wherein said circulation port is defined in a nozzle removably positioned in said housing.

23. The locator of claim 22 wherein said nozzle is one of a plurality of interchangeable nozzles having differently sized circulation ports therein.

24. The locator of claim 1 wherein said circulation port is longitudinally disposed in said housing.

25. The locator of claim 1 further comprising:

an insert disposed in said housing, said insert defining a flow conduit therethrough.

26. The locator of claim 25 wherein said flow conduit communicates said central opening in said housing with said circulation port.

27. An apparatus for locating joints in a well pipe string comprising:

a housing having an upper end connectable to a length of coiled tubing and defining a central opening therethrough and a circulation port in communication with said central opening;

an electronic assembly disposed in said housing and comprising:

a sensing means for detecting an increased mass of a pipe joint; and an electric module comprising a power source and an electric circuit connected thereto and to said sensing means, said electric circuit generating a momentary electric output signal in response to the detection of said increased mass by said sensing means, said electric module being removable as an integral unit from said housing; and valve means disposed in said housing for momentarily opening or closing communication between said central opening and said circulation port in response to said electric output signal and to a pressure differential between the coiled tubing and a well annulus outside said circulation port.

28. The apparatus of claim 27 wherein said electric module comprises:

a case defining a first cavity for receiving said power source therein and a second cavity for receiving said circuit therein, said case being releasably attachable to said housing.

29. The apparatus of claim 28 further comprising a tube disposed in said housing and extending through said case and forming a portion of a fluid passageway through said housing, said fluid passageway being in communication with said circulation port when said valve means is open.

30. The apparatus of claim 27 wherein said sensing means comprises:

an electromagnetic coil and magnet for electromagnetically sensing the increased mass of a pipe joint.

31. The apparatus of claim 27 wherein said sensing means comprises:

a giant magnetoresistive digital field sensor for electromagnetically sensing the increased mass of a pipe joint.

32. The apparatus of claim 27 wherein said circulation port is defined in a nozzle removably disposed in said housing.

33. The apparatus of claim 32 wherein said nozzle is one of a plurality of interchangeable nozzles having different sizes of circulation ports defined therein.

34. An apparatus for locating joints in a well pipe string comprising:

a housing having an upper end connectable to a length of coiled tubing and defining a central opening therethrough and a circulation port in communication with said central opening;

an electronic assembly disposed in said housing and comprising:

a sensing means for detecting an increased mass of a pipe joint; and an electric module comprising a power source and an electric circuit connected thereto and to said sensing means, said electric circuit generating a momentary output signal in response to the detection of said increased mass by said sensing means, said electric module being removable as an integral unit from said housing;

valve means disposed in said housing for momentarily opening or closing communication between said central opening and said circulation port in response to said electric output signal, said valve having a piston portion movable in response to a pressure differential between said central opening of said housing and a well annulus defined outside said housing; and a solenoid adapted for activation in response to said electric output signal and thereby placing said valve in communication with pressure in said central opening of said housing.

35. The apparatus of claim 34 further comprising biasing means to return said piston portion to the original position thereof after said solenoid is deactivated.

36. The apparatus of claim 34 wherein:

said housing defines a pilot passageway therein in communication with a first portion of said piston portion of said valve and defines an annulus port in communication with a second portion of said piston portion; and said solenoid is a pilot solenoid adapted for opening said pilot passageway in response to said electric output signal.

37. The apparatus of claim 34 wherein said electric circuit comprises time delay means for preventing supply of power from said power source to said solenoid before a predetermined time delay has elapsed.

38. The apparatus of claim 37 wherein said time delay means provides a test time period to allow supply of power from said power source to said solenoid before said time delay has been initiated.

39. An apparatus for locating joints in a well pipe string comprising:

a housing having an upper end connectable to a length of coiled tubing and defining a central opening therethrough and a circulation port in communication with said central opening;

an electronic assembly disposed in said housing and comprising:

a sensing means for detecting an increased mass of a pipe joint; and an electric module comprising a power source and an electric circuit connected thereto and to said sensing means, said electric circuit generating a momentary electric output signal in response to the detection of said increased mass by said sensing means, said electric module being removable as an integral unit from said housing;

valve means disposed in said housing for momentarily opening or closing communication between said central opening and said circulation port in response to said electric output signal; and pressure isolation means for preventing premature communication between the pressure in the coiled tubing and any tool positioned below the apparatus.

40. The apparatus of claim 39 wherein said pressure isolation means comprises a rupture disk.

41. The apparatus of claim 39 wherein said pressure isolation means comprises:

a valve having a seat thereon and a flow passageway therethrough, said valve having a closed position wherein flow through said passageway is prevented and an open position wherein flow through said passageway is allowed; and a ball engagable with said seat such that fluid communication through said circulation port is prevented, and when a predetermined pressure is applied to said valve and ball, said valve is moved from said closed position to said open position thereof.

42. The locator of claim 41 wherein said valve comprises:

a seat body fixedly disposed in said housing and forming a lower portion of said flow passageway; and a seat sleeve slidably disposed in said seat body and forming an upper portion of said flow passageway, said upper portion of said passageway being in communication with said lower portion of said passageway when said valve is in said open position thereof.

43. The locator of claim 42 wherein said valve further comprises shear means for initially shearably holding said seat sleeve in said closed position thereof.

44. The apparatus of claim 41 wherein said pressure isolation means further comprises a rupture disk disposed below said valve.

45. An apparatus for locating joints in a well pipe string comprising:

a housing having an upper end connectable to a length of coiled tubing and defining a central opening therethrough and a circulation port in communication with said central opening;

an electronic means disposed in said housing for detecting an increased mass of a pipe joint and generating a momentary electric output signal in response thereto;

valve means disposed in said housing for momentarily opening and closing communication between said central opening and said circulation port in response to said electric output signal and thereby placing said valve in communication with pressure in the coiled tubing; and pressure isolation means for preventing premature communication between the pressure in the coiled tubing and any tool positioned below the apparatus.

46. The apparatus of claim 45 wherein said pressure isolation means comprises a rupture disk.

47. The apparatus of claim 45 wherein said pressure isolation means comprises:

a valve having a seal thereon and a flow passageway therethrough;

said valve having a closed position wherein flow through said passageway is prevented and an open position wherein flow through said passageway is allowed; and a ball engagable with said seat such that fluid communication through said circulation port is prevented and when a predetermined pressure is applied to said valve and ball, said valve is moved from said closed position to said open position thereof.

48. The locator of claim 47 wherein said valve comprises:

a seat body fixedly disposed in said housing and forming a lower portion of said flow passageway; and a seat sleeve slidably disposed in said seat body and forming an upper portion of said flow passageway, said upper portion of said passageway being in communication with said lower portion of said passageway when said valve is in said open position thereof.

49. The locator of claim 48 wherein said valve further comprises shear means for initially shearably holding said seat sleeve in said closed position thereof.

50. The apparatus of claim 47 wherein said pressure isolation means further comprises a rupture disk disposed below said valve.

51. The apparatus of claim 45 wherein:

said valve means is adapted to open or close in response to a pressure differential between the coiled tubing and a well annulus outside said circulation port; and said electronic means comprises a pilot solenoid which opens in response to said signal and thereby places said valve means in communication with the pressure in the coiled tubing.

52. The apparatus of claim 51 wherein said housing defines:

a pilot passageway therein in communication with an upper portion of said valve means; and an annulus port in communication with a lower portion of said valve means;

wherein, said solenoid is adapted to open said pilot passageway in response to said signal.

53. The apparatus of claim 51 wherein said electronic means further comprises:

a power supply for supplying power to said pilot solenoid; and time delay means for preventing communication of power from said power supply to said pilot solenoid prior to a predetermined time delay.

54. The apparatus of claim 53 wherein said time delay means includes a test time period allowing communication of power from said power supply to said pilot solenoid prior to initiation of said predetermined time delay.

55. The apparatus of claim 45 wherein said electronic means comprises:

an electromagnetic coil and magnet for electromagnetically sensing the increased mass of a pipe joint.

56. The apparatus of claim 55 wherein said electronic means further comprises:

an electric power source; and an electric circuit means for generating said signal when said coil electromagnetically senses said increased mass.

57. The apparatus of claim 56 further comprising:

an electric case in which said power source and said electric circuit means are disposed, said case being removable from said housing.

58. The apparatus of claim 57 wherein said case is threadingly connected to an upper end of said housing.

59. The apparatus of claim 45 wherein said electronic means comprises:

a giant magnetoresistive digital field sensor for electromagnetically sensing the increased mass of a pipe joint.

60. The apparatus of claim 59 wherein said electronic means further comprises:

an electric power source; and an electric circuit means for generating said signal when said sensor electromagnetically senses said increased mass.

61. The apparatus of claim 60 further comprising:

an electric case in which said power source, said electric circuit means and said sensor are disposed, said case being removable from said housing.

62. The apparatus of claim 61 wherein said case is threadingly connected to an upper end of said housing.

63. The apparatus of claim 45 wherein said circulation port is defined in a nozzle which is replaceably disposed in said housing.

64. The apparatus of claim 63 wherein said nozzle is one of a plurality of interchangeable nozzles, each of said nozzles having a differently sized circulation port therein.

65. An apparatus for locating joints in a well pipe string comprising:

a housing having an upper end connectable to a length of coiled tubing and defining a central opening therethrough and a circulation port at a lower end of said housing;

an insert disposed in said housing and defining a flow conduit between said central opening of said housing and said circulation port;

an electronic means disposed in said housing for detecting an increased mass of a pipe joint and generating a momentary electric output signal in response thereto; and valve means disposed in said housing for momentarily opening and closing said flow conduit in response to said electric output signal.

66. The apparatus of claim 65 wherein said central opening and said circulation port extend longitudinally in said housing.

67. The apparatus of claim 65 wherein said insert defines a transversely extending port, said transversely extending port being uncovered and covered, respectively, when said valve means is opened and closed.

68. The apparatus of claim 65 wherein:

said valve means is adapated to open or close said flow conduit in response to a pressure differential between the coiled tubing and a well annulus outside said housing; and said electronic means comprises a pilot solenoid which opens in response to said signal and thereby places said valve means in communication with the pressure in the coiled tubing.

69. The apparatus of claim 68 wherein said housing defines:

a pilot passageway therein in communication with an upper portion of said valve means; and an annulus port in communication with a lower portion of said valve means;

wherein, said solenoid is adapted to open said pilot passageway in response to said signal.

70. The apparatus of claim 65 wherein said electronic means further comprises:

a power supply for supplying power to said pilot solenoid; and time delay means for preventing communication of power from said power supply to said pilot solenoid prior to a predetermined time delay.

71. The apparatus of claim 70 wherein said time delay includes a test time period allowing communication of power from said power supply to said pilot solenoid prior to initiation of said predetermined time delay.

72. The apparatus of claim 65 wherein said electronic means comprises an electromagnetic coil and magnet for electromagnetically sensing the increased mass of a pipe joint.

73. The apparatus of claim 72 wherein said electronic means further comprises:

an electric power source; and an electric circuit means for generating said signal when said coil electromagnetically senses said increased mass.

74. The apparatus of claim 73 further comprising an electric case in which said power source and said electric circuit means are disposed, said case being removable from said housing.

75. The apparatus of claim 74 wherein said case is threadingly connected to an upper end of said housing.

76. The apparatus of claim 65 wherein said electronic means comprises a giant magnetoresistive digital field sensor for electromagnetically sensing the increased mass of a pipe joint.

77. The apparatus of claim 76 wherein said electronic means further comprises:

an electric power source; and an electric circuit means for generating said signal when said sensor electromagnetically senses said increased mass.

78. The apparatus of claim 77 further comprising an electric case in which said power source, said electric circuit means and said sensor are disposed, said case being removable from said housing.

79. The apparatus of claim 78 wherein said case is threadingly connected to an upper end of said housing.

80. The apparatus of claim 65 wherein:

said valve means comprises a piston reciprocably disposed in said housing, said piston having a sleeve portion; and a portion of said insert extends into said sleeve portion.

81. An apparatus for locating joints in a well pipe string comprising:

a housing having an upper end connectable to a length of coiled tubing and defining a central opening therethrough and a circulation port in communication with said central opening;

an electronic assembly disposed in said housing and comprising:

a sensing means for detecting an increased mass of a pipe joint; and an electric module comprising a power source and an electric circuit connected thereto and to said sensing means, said electric circuit generating a momentary electric output signal in response to the detection of said increased mass by said sensing means, said electric module being removable as an integral unit from said housing;

valve means disposed in said housing for momentarily opening or closing communication between said central opening and said circulation port in response to said electric output signal; and an insert defining a flow conduit therethrough providing communication between said central opening in said housing and said circulation port.

* * * * *